US006679017B2

(12) United States Patent
Woodruff, III et al.

(10) Patent No.: US 6,679,017 B2
(45) Date of Patent: Jan. 20, 2004

(54) PREFORMED BOLT-ON HAUNCH SYSTEM

(76) Inventors: James F. Woodruff, III, 404 Halstead Bayou, Ocean Springs, MS (US) 39560; Kevin L. Kirkley, 555 Lakeshore Dr., Stockbridge, GA (US) 30281; Joseph M. Golden, 421 Old Ivy Path, McDonough, GA (US) 30253

( * ) Notice: Subject to any disclaimer, the term of this patent is extended or adjusted under 35 U.S.C. 154(b) by 0 days.

(21) Appl. No.: 10/047,908

(22) Filed: Jan. 15, 2002

(65) Prior Publication Data

US 2003/0131547 A1 Jul. 17, 2003

(51) Int. Cl.[7] ..... E04B 7/00
(52) U.S. Cl. ..... 52/283; 403/360
(58) Field of Search ..... 52/283, 703, 253, 52/252, 251, 289; 403/373, 374.3, 360, 265, 267

(56) References Cited

U.S. PATENT DOCUMENTS

| | | | | | |
|---|---|---|---|---|---|
| 869,869 | A | * | 10/1907 | Lally | 52/283 |
| 961,211 | A | * | 6/1910 | Conzelman | 52/283 |
| 1,929,835 | A | | 10/1933 | Awbrey | |
| 1,933,536 | A | | 11/1933 | Awbrey | |
| 2,079,478 | A | | 5/1937 | Bashe | |
| 2,163,446 | A | | 6/1939 | Heckman | |
| 2,724,261 | A | * | 11/1955 | Rensaa | 52/295 |
| 3,261,135 | A | * | 7/1966 | Knabe | 52/127.12 |
| 3,513,610 | A | * | 5/1970 | Devonport | 52/283 |
| 3,722,159 | A | * | 3/1973 | Kessler | 52/252 |
| 3,733,757 | A | * | 5/1973 | Scott | 52/105 |
| 3,750,063 | A | * | 7/1973 | Lowen et al. | 335/206 |
| 4,696,137 | A | * | 9/1987 | Schleich | 52/251 |
| 4,838,737 | A | * | 6/1989 | Quimby | 405/230 |
| 4,951,438 | A | | 8/1990 | Thoresen | |
| 5,311,629 | A | * | 5/1994 | Smith | 14/73.1 |
| 5,342,138 | A | * | 8/1994 | Saito et al. | 403/189 |
| 5,536,113 | A | * | 7/1996 | McGregor | 405/125 |
| 5,678,375 | A | * | 10/1997 | Juola | 52/655.1 |
| 5,711,122 | A | * | 1/1998 | Lee | 52/283 |
| 5,826,395 | A | | 10/1998 | Weaver | |
| 5,978,997 | A | * | 11/1999 | Grossman | 14/73 |

FOREIGN PATENT DOCUMENTS

| | | | | |
|---|---|---|---|---|
| JP | 410147984 A | * | 6/1998 | E04B/1/30 |

* cited by examiner

*Primary Examiner*—Korie Chan
(74) *Attorney, Agent, or Firm*—Dority & Manning

(57) ABSTRACT

A preformed assembly for providing an offset support for a vertically extending concrete structure is provided, including a receptacle for being embedded in the concrete structure and an attachable offset support for projecting out from the receptacle. The receptacle has anchors for anchoring the receptacle in the concrete structure, openings adapted for receipt of the offset support member, and a securing member. The attachable offset support member has a rigid load bearing plate on its upper surface. The support member has a load support that projects beyond the rear bearing side, to be inserted into one of the receptacle openings, for supporting the offset support member thereon. The support member also has a tension member extending through it to engage the receptacle securing member, for drawing the support member against the receptacle.

21 Claims, 6 Drawing Sheets

PREFORMED BOLT-ON HAUNCH SYSTEM

CROSS-REFERENCES TO RELATED APPLICATIONS

Not Applicable

STATEMENT REGARDING FEDERALLY SPONSORED RESEARCH OR DEVELOPMENT

Not Applicable

FIELD OF THE INVENTION

The present invention relates to a system of providing a supporting structure, and more particularly a haunch and mating receptacle, to carry horizontally extending structures from vertically extending concrete walls, columns, and the like.

Haunches and other supports have been utilized in the past for carrying horizontally extending structures from vertically extending columns or walls. The haunches that are mounted to receptacles have included metal housings that are encapsulated in concrete. One problem with such systems is that, when loads were placed on top of the haunches, the loads are borne directly by the concrete, yet the loads cause the concrete encapsulating the haunches to spall, pit, chip, deteriorate, or possibly shift.

Other haunch systems also include receptacles that are precast within the column or wall. According to such systems, the receptacle is positioned during the creation of the column or wall, in the concrete during pouring in a concrete mold or form. However, upon the setting of the concrete and the lifting of the column or wall by crane or other equipment, before use of the column or wall in the building construction the haunch has to be welded to the receptacle, which may require difficult, awkward, and potentially hazardous bodily positioning by the welders. In applications in which the building geometry dictates that the receptacle be positioned at the bottom of the concrete form during the pouring of the liquid concrete, such difficulties are exacerbated because later welding to the bottom-positioned receptacle allows hot sparks and welding slag to fall by gravity toward the welder. Additionally, the requirement for tradesmen such as welders on the construction site increases personnel costs, and in turn construction costs.

Further, other haunch systems have required the use of unique, specialty fasteners, by which the support member is attached to the receptacle. Such custom components add complication to the attachment job. Furthermore, worker familiarity with such fasteners is not uniform, nor great, nor reliable. More common fasteners, such as the simple bolt, are not provided by such systems. Accidental damage to or destruction of such fasteners often requires replacement of the entire receptacle unit, because replacement of the unique fasteners may only be had from the custom manufacturer of the component; time of construction is thereby delayed.

Further, other haunches have been created in the mold or concrete form—rather than simply pour a column or wall, the concrete form is configured so as to result in an offset portion that, when the column or wall is erected, support can be rested upon the portion so as to bear loads. Such haunches, however, require more complicated mold construction, often require the destruction of the mold so as to remove the structural member after the concrete sets and the reconstruction of duplicate molds thereafter for additional building members, and increase the time required for construction. Such haunch systems do not provide for the repeatable formation of building columns, walls, and the like.

Finally, other haunch systems have required the use of multiple fasteners to effect attachment of the haunch to the column or wall receptacle. Such multiple fasteners reduce the speed and effectiveness with which the building system may be erected, and multiply the opportunity for error by workers erecting the building system.

Examples of United States patents for devices that are to be used to join separate members in concrete structures may include U.S. Pat. No. 2,163,446, "Insert Anchor"; U.S. Pat. No. 2,079,478, "Concrete Insert"; U.S. Pat. No. 1,929,835, "Concrete Insert"; U.S. Pat. No. 1,933,536, "Concrete Insert"; U.S. Pat. No. 3,513,610, "Concrete Structural Member: Framework Structure And Casting Method"; U.S. Pat. No. 5,711,122, "Supporting Device For Supporting A Floor Form Assembly On Surrounding Walls Of A Structure"; U.S. Pat. No. 4,951,438, "Building Construction"; U.S. Pat. No. 5,311,629, "Deck Replacement System With Improved Haunch Lock"; U.S. Pat. No. 2,724,261, "Precast Column Attaching Means"; U.S. Pat. No. 3,733,757, "Concrete Building Frame Construction"; U.S. Pat. No. 5,826,395, "Concrete Block With Offset Ledge And Installation Guide Means"; and U.S. Pat. No. 3,261,135, "Precast Concrete Beam And Column Joint Construction."

The present invention relates to an improved system of providing a supporting structure to carry horizontally extending structures from vertically extending concrete walls, columns, and the like.

BRIEF SUMMARY OF THE INVENTION

The present invention solves the problems and drawbacks identified above by providing a new preformed haunch assembly.

Accordingly, it is an object of the present invention to provide a haunch assembly that produces a minimum of deterioration with regard to its load supporting function over long periods of time.

Another object of the present invention is to provide a haunch assembly that, when being used for supporting horizontal structures, provides long term dimensional stability.

A further object of the invention is to provide a haunch assembly that has a smooth load bearing surface that remains dimensionally stable throughout the life of the structure.

A further object of the present invention is to provide a metal load bearing surface to the haunch portion of the load bearing system and enable the system to be encapsulated in cementious material such as concrete, yet to avoid spalling, pitting, chipping, deterioration, or shifting the material and structure of the haunch under load over time.

A further object of the present invention is to enable the use of the haunch system in bottom in form locations of the haunch receptacle during pouring of the concrete column or wall, and the attachment of the haunch to the receptacle after the pouring of the concrete column or wall, yet to avoid thereafter attaching the haunch to the receptacle by welding.

A further object of the present invention is to enable the attachment of the haunch to the receptacle by readily available common fastener devices.

A further object of the present invention is to enable the attachment of the haunch to the receptacle by a single fastening device.

The invention relates to a preformed assembly for providing an offset support from a vertically extending concrete structure. The assembly includes a receptacle that is embedded in a vertically extending column or wall, with an attachable offset support member for projecting out from the receptacle to provide a horizontally extending structural support. The receptacle includes a facing plate having an exposed side and an opposing back side. A plurality of anchors extend from the back side of the facing plate for anchoring the receptacle in the concrete wall structure. At least a first opening and second opening is provided in the face plate for receiving supporting elements carried by the offset support member. The receptacle has a securing member, and in one particular embodiment in the form of a threaded nut, that is carried by the back side of the facing plate.

The attachable offset supporting member may be formed and made in advance off site to the construction, and many such members may be created from a single mold used repeatedly. The offset supporting member includes a housing having an upper surface and a lower surface with an intermediate section provided therebetween. A rigid load bearing plate is carried on the upper surface of the housing. Positioned adjacent the lower end of the housing is a load supporting member that has a protruding end portion that projects beyond a rear bearing side of the housing and extends through one of the openings provided in the receptacle into a recess in the concrete wall. A tensioning member, such as a bolt, extends through an intermediate section of the housing with an end portion projecting beyond the rear bearing side of the housing for threadably engaging the securing member for tightly drawing the rear bearing side of the housing against the exposed side of the facing plate of the receptacle. The load supporting member is vertically spaced from the tensioning member, for rigidly securing the support member in the receptacle provided in the concrete wall. As a result, the load bearing plate positioned on top of the support member is maintained in a horizontal orientation so that a floor or horizontal structure can be readily positioned on top thereof.

Additional objects and advantages of the invention will be set forth in part in the following description, or may be obvious from the description, or may be learned through practice of the invention. The described features, as well as other features, aspects, and advantages of the present invention will be better understood with reference to the following description and appended claims. The accompanying drawings, which are incorporated in and constitute a part of this specification, illustrate exemplary embodiments of the invention and, together with a description, serve to explain the principles of the invention.

DETAILED DESCRIPTION OF THE INVENTION

Figure 1:
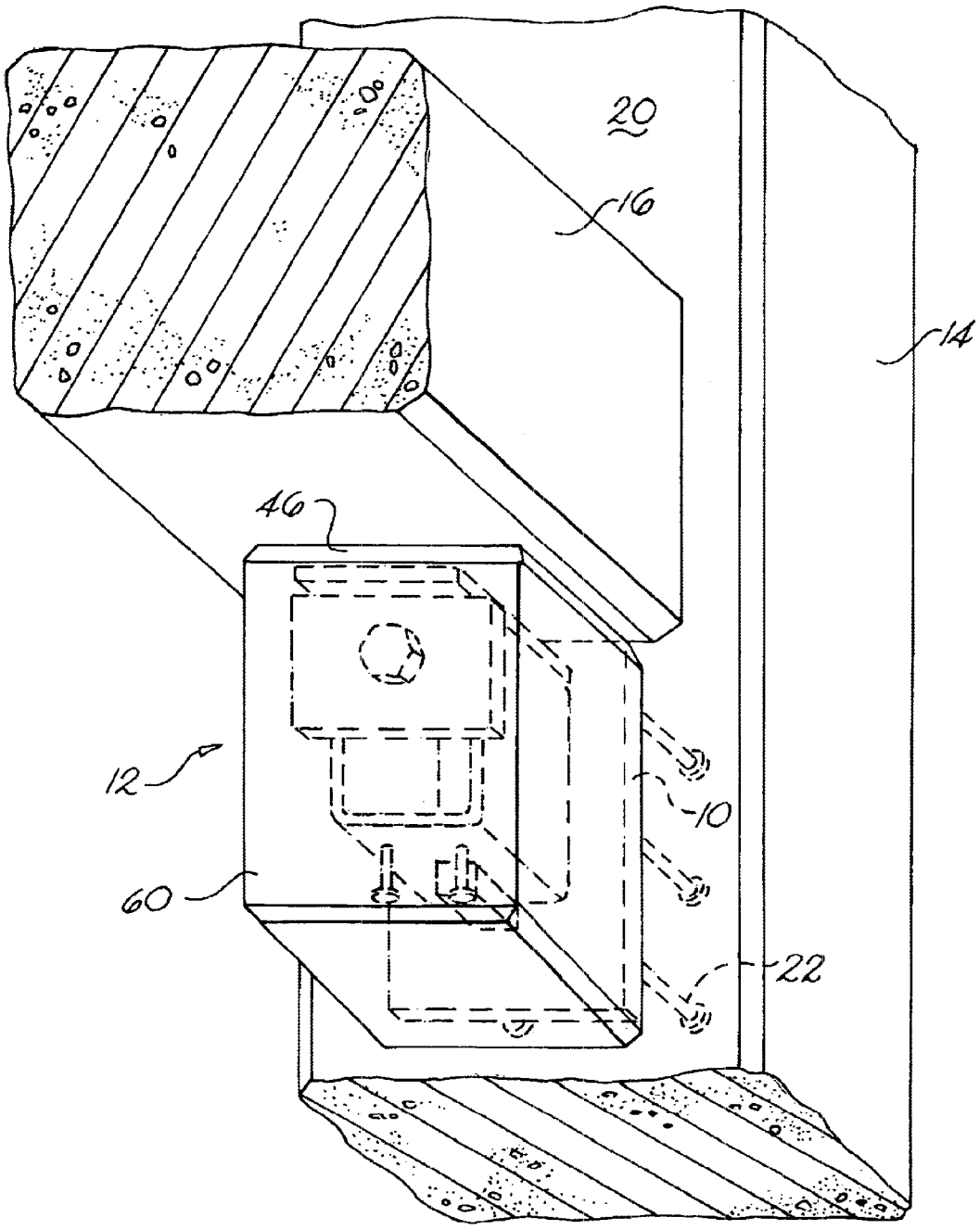
FIG. 1 is a perspective view taken from the lower front and illustrating one embodiment of the invention, as installed in a vertically extending column and supporting a horizontal load.
Figure 2:
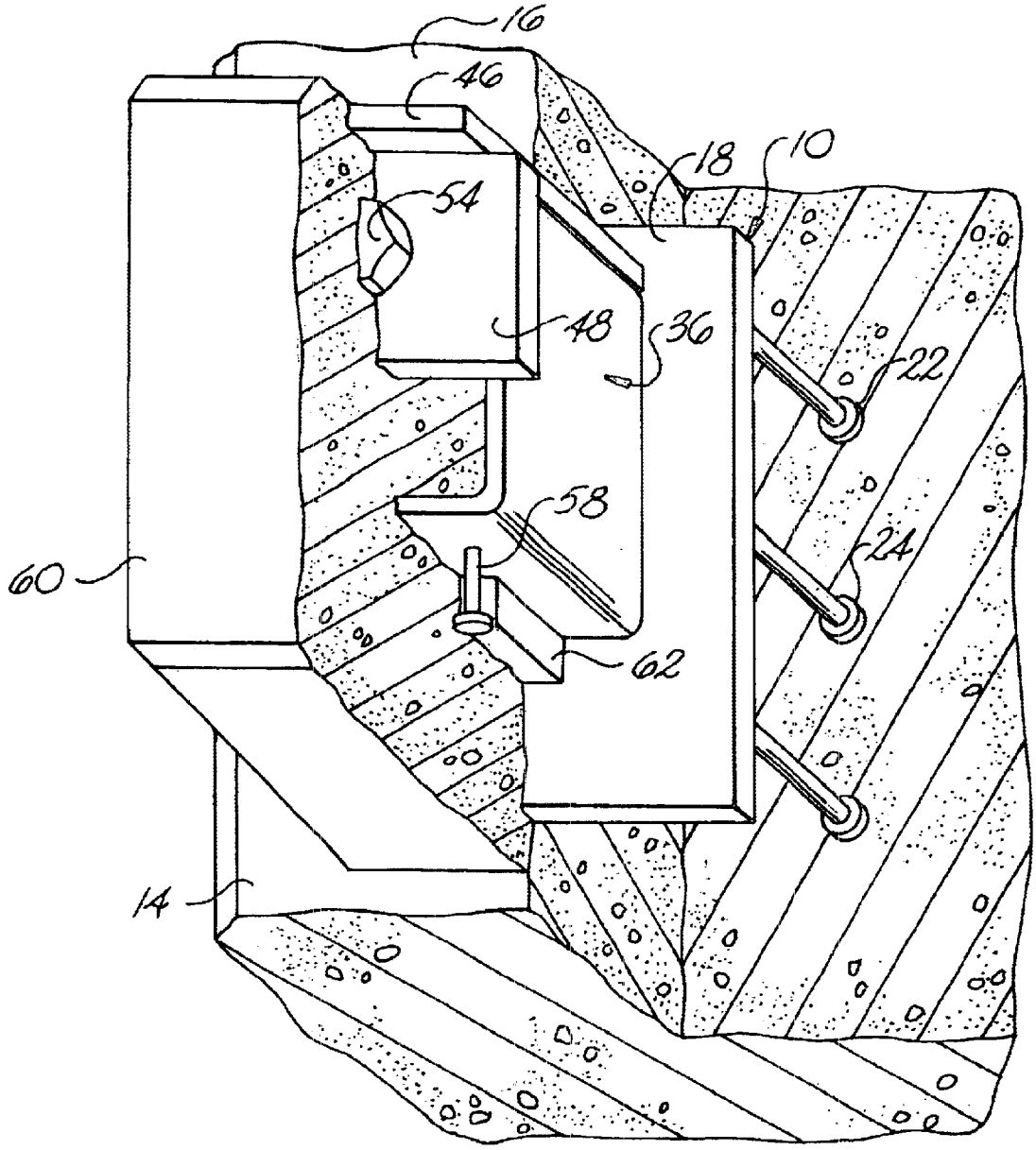
FIG. 2 is a perspective view taken from the lower front of one embodiment of the invention, with portions removed for purposes of illustration, as installed in a vertically extending column and supporting a horizontal load.
Figure 3:
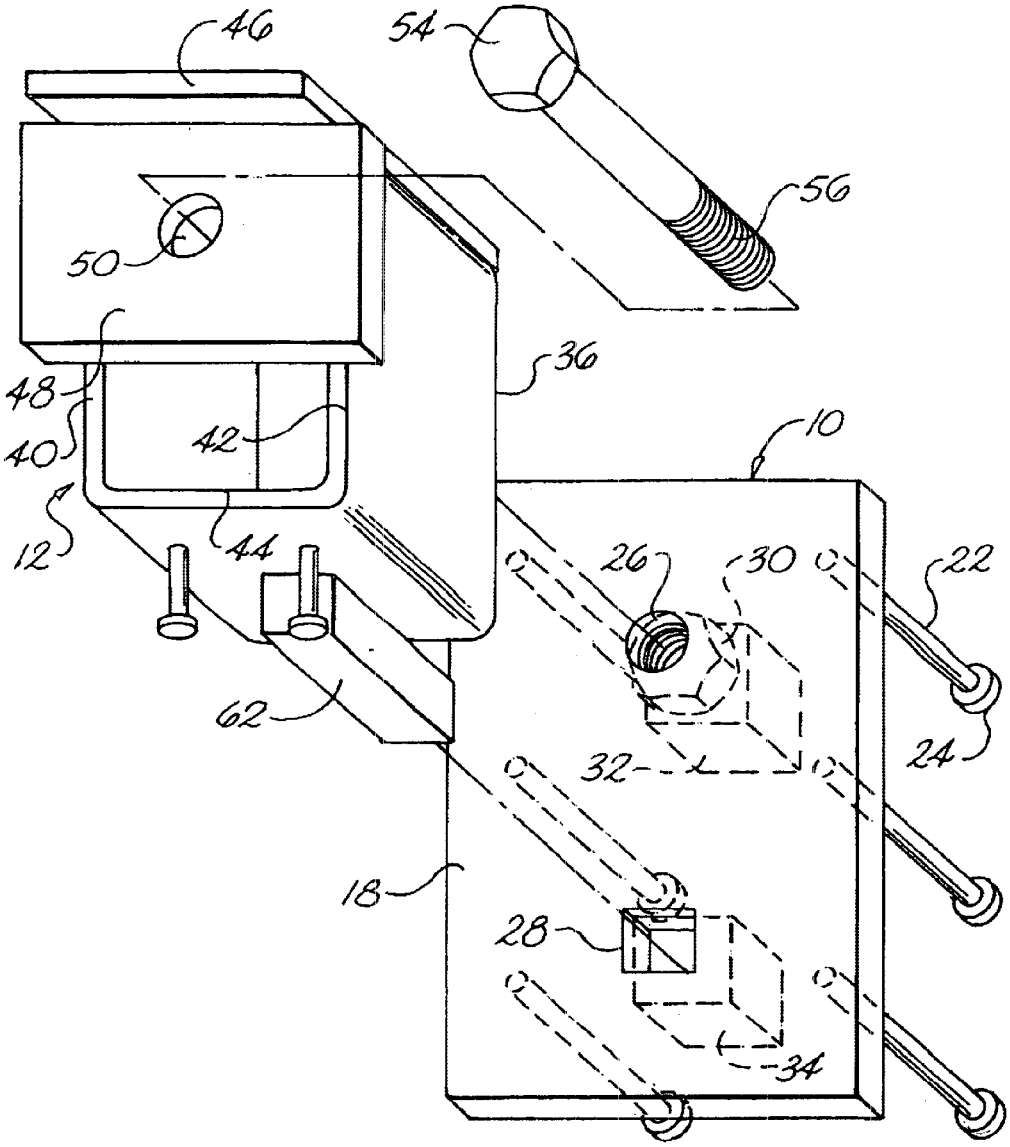
FIG. 3 is an exploded view of the basic components of the invention.

Reference will now be made in detail to the presently preferred embodiments of the invention, one or more examples of which are illustrated by the appended drawings. Each example is provided by way of explanation of the invention, and is not meant as a limitation of the invention. For example, features illustrated or described as part of one embodiment can be used on another embodiment to yield a still further embodiment. It is intended that the present application include such modifications and variations as come within the scope and spirit of the invention.

Referring to the appended figures generally, the preformed assembly includes a receptacle generally designated by the reference character 10 and an offset support member generally designated by the reference character 12. The receptacle is embedded in a concrete column 14 that extends vertically. Normally, the receptacle is inserted in the column 14 when the column is being poured and prior to the concrete setting.

As shown in FIG. 1, a horizontally extending beam 16 is supported on the upper surface of the offset support member 12.

The receptacle 10 is embedded in the concrete column 14 and has a facing plate 18 that is flush with the outer surface 20 of the column. Extending rearward from the facing plate 18 are a plurality of anchors 22 that are rod-shaped and terminate in an enlarged head 24 that securely holds the facing plate in the concrete wall.

The facing plate has a pair of holes 26 and 28 provided therein. In the embodiment illustrated in the drawings, hole 26 has a round cross-sectional shape and hole 28 has square cross-sectional shape. Hole 26 is vertically spaced from the hole 28 and allows for the passage of a tensioning pin such as a threaded bolt. Positioned on the back side of the plate and surrounding the hole is a securing member 30, that in the preferred embodiment is in the form of a nut. The securing member is secured to the back side of the facing plate 18 by any suitable means, such as welding, to prevent its movement relative to the facing plate.

Directly behind the nut 30 is recess forming member 32 that is constructed of any suitable compressible material, such as polystyrene. A similar compressible recess forming material 34 is positioned on the back side of the facing plate 18 around the lower hole 28. Recess forming members 32 and 34 can be attached to the rear side of the facing plate by any suitable means, such as adhesive.

Figure 4:
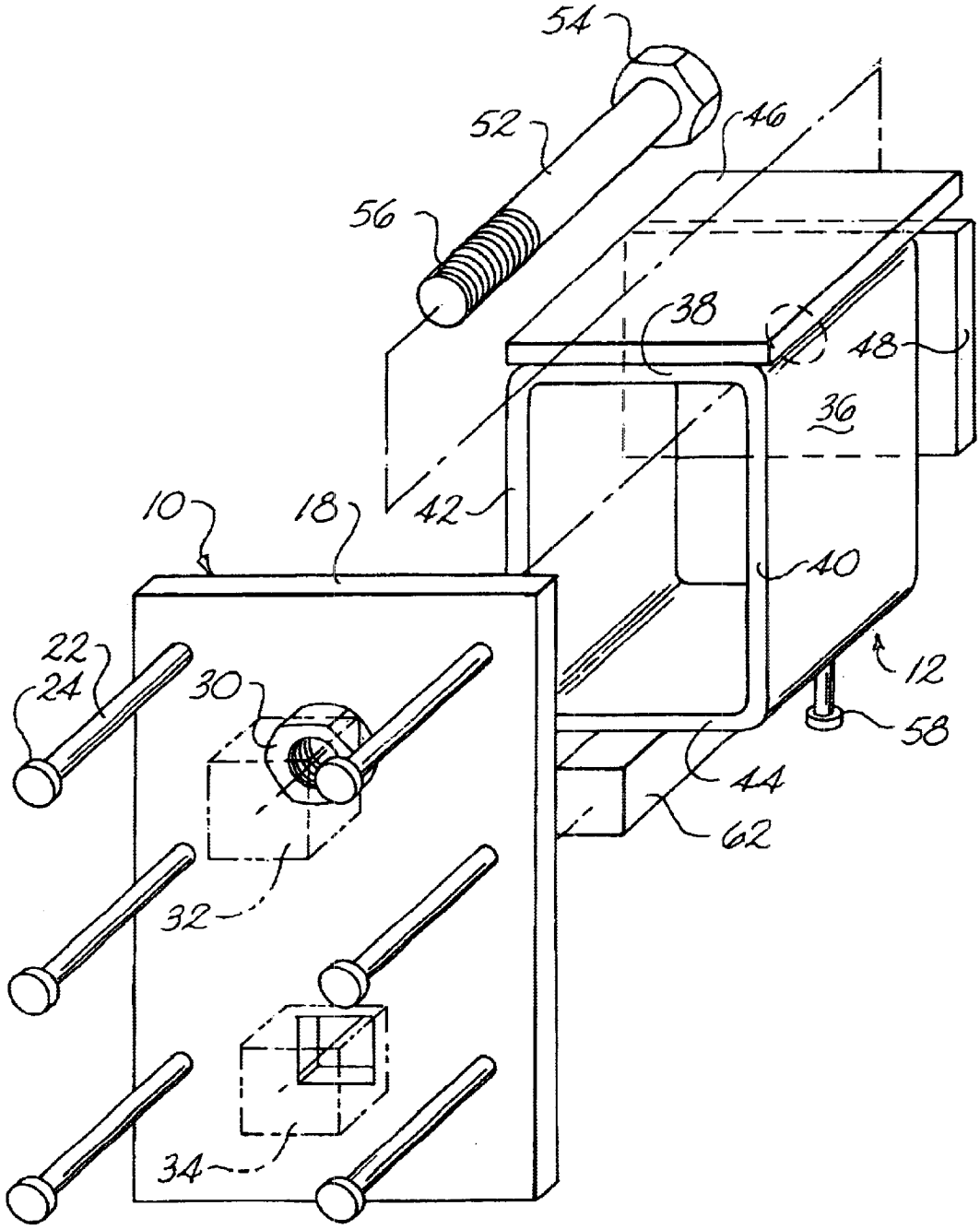
FIG. 4 is a different perspective view of the basic components of the invention.
Figure 5:
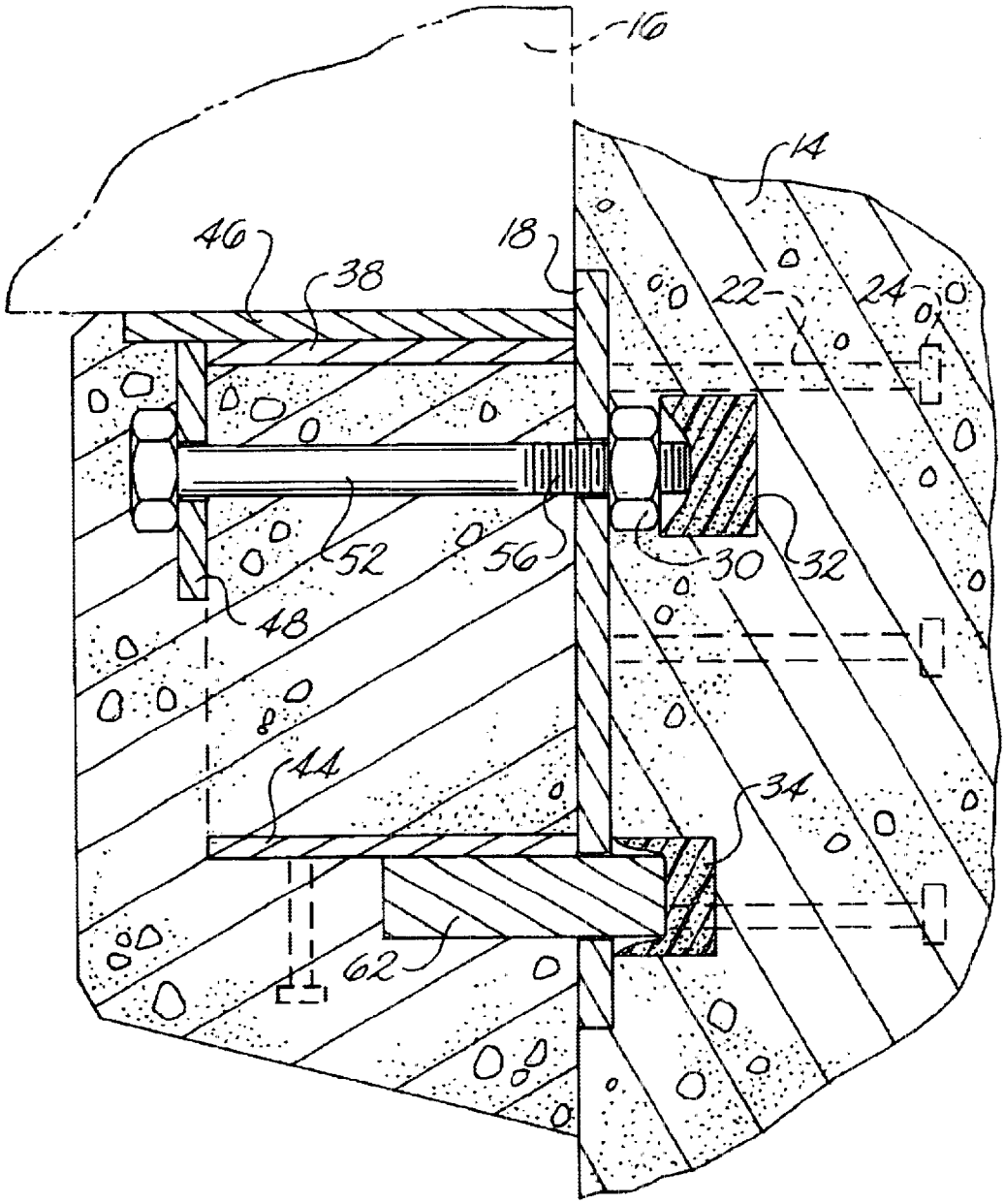
FIG. 5 is a cross-sectional view illustrating the invention mounted on a column supporting a load.
Figure 6:
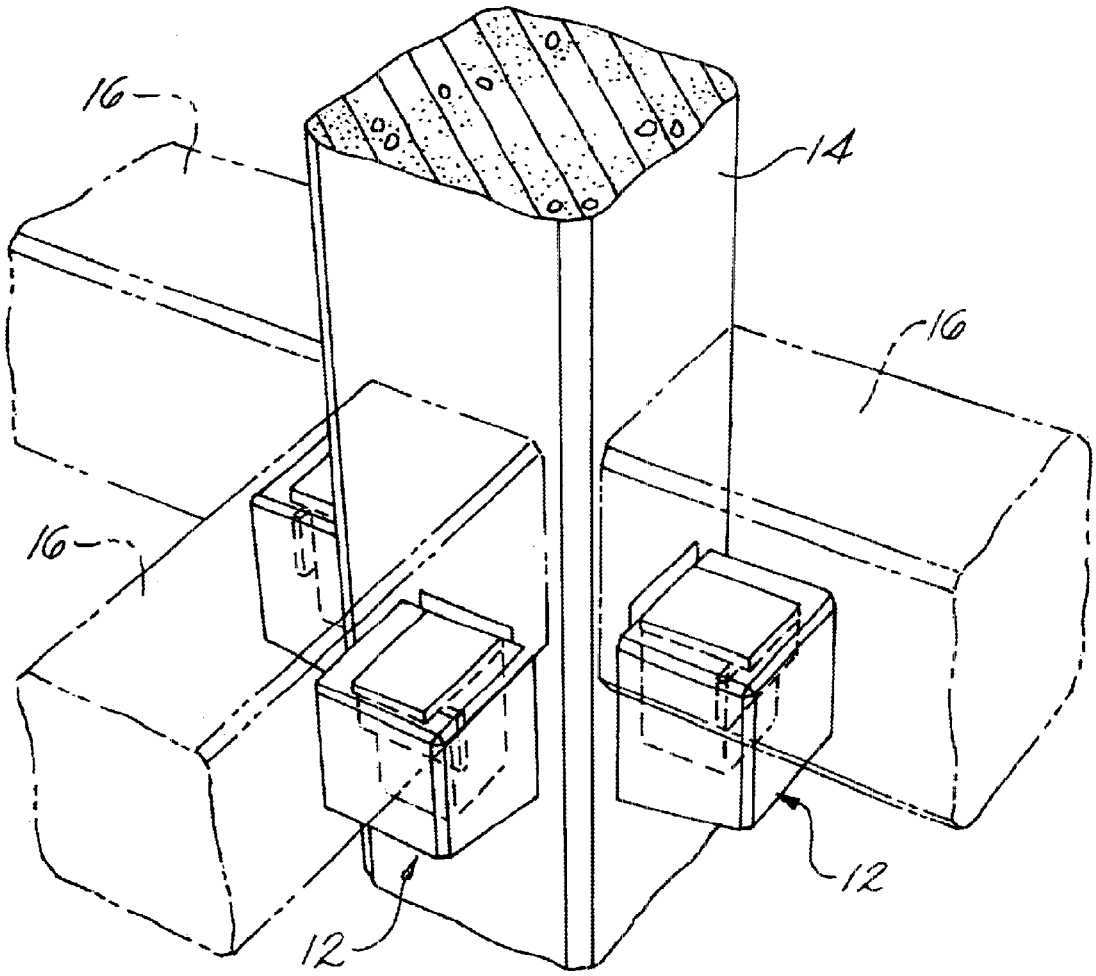
FIG. 6 is a perspective view illustrating three preformed assemblies supporting three horizontally extending members from a vertically extending column.

The attachable offset support member 12 includes, as shown in FIG. 4, a rectangular shaped metallic housing 36 that includes an upper wall 38 and opposed side walls 40 and 42 that are joined by a lower wall 44. Such walls 38, 40, 42, and 44 define a cavity therebetween. Positioned on top of the upper wall 38 is a rectangular shaped load bearing plate 46. The load bearing plate is of sufficient thickness as to resist deformity under loads to be placed thereon.

A vertically extending plate 48 is secured to the front side of the housing 36 and has an opening 50 provided therein through which tensioning member 52 extends. The head 54 of the anchoring bolt is drawn against the face of the plate 50 when the offset support member is drawn tightly against the receptacle. The outer end of the bolt 52 has threads 56 provided thereon so that such can threadably engage the nut 30 provided in the receptacle 10. Extending downwardly from the lower side 44 of the housing 36 are anchoring pins 58 that are used for anchoring the housing within a concrete encasement 60. A load supporting member 62 is secured to the bottom surface 44 of the housing 36 and projects beyond the rear of the housing so as to be inserted through opening 28 provided in face plate 18 of the receptacle. In the embodiment illustrated, the load support member has a substantially rectangular cross-section and a flat lower surface that rests on the complimentary surface of the square opening 28 provided in the face plate of the housing. The outer end of the load supporting member extends through the opening 28 and, when being positioned on the receptacle, engages the compressible recess forming member 34 to compress the recess forming member 34 sufficiently to allow the housing 36 of the attachable offset support member to be drawn tightly against the facing plate 18. Similarly, recess forming member 32 permits the tensioning member to be rotated to draw the housing tightly against the facing plate, and as such occurs, the outer end 56 of the anchor bolt 52 compresses the material 32.

The entire housing of the offset supporting member is encapsulated in concrete. Concrete also extends into the cavity of the housing for producing a stronger structure for supporting loads.

Plate 46, so configured, serves to distribute the load, such as beam 16, more evenly and appropriately over housing 36 and concrete encasement 60, so as in turn to provide a more rigid, durable, and non-deteriorating offset support for loads. Plate 46, so configured, further serves to prevent the collapse of the cavity formed by the walls of housing 36 and further serves to stabilize horizontal loads on the offset support member. Plate 46 may be attached to the housing and a vertically extending plate 48 by a variety of suitable means, but in one embodiment plate 46 is welded both to upper housing wall 38 and to vertically extending plate 48.

When mounting the preformed assembly on a wall, the attachable offset member is positioned first with the load support member extending through the opening 28 in the facing plate of the receptacle 10. As a result of the bottom surface of the load support member being flat, it rests on the flat complimentary surface of the facing plate and aids in stabilizing the offset member 12 relevant to the receptacle 10. The anchoring bolt 52 is then threaded into the securing member or nut 30 and rotated until the edge of the housing 36 is drawn tightly against the facing plate. The primary support for the offset support member 12 is the load supporting member 62.

Those skilled in the art will appreciate that various modifications and variations may be made in the present invention without departing from the scope and the spirit of the invention. It is intended that the present invention include such modifications and variations as may come within the scope of the appended claims and their equivalents.

What is claimed is:

1. A preformed assembly for providing an offset support for a vertically extending concrete structure, comprising:

(a) a receptacle for being embedded in a vertically extending concrete structure and an attachable offset support member for projecting out from said receptacle to provide a structural support;

(b) said receptacle including:

(i) a facing plate having an exposed side and an opposing back side;

(ii) a plurality of anchors extending from said back side of said facing plate for anchoring said receptacle in said concrete structure;

(iii) at least a first opening and a second opening provided in said face plate;

(iv) a securing member carried by said backside of said facing plate;

(c) said attachable offset support member including:

(i) a housing having an upper surface and a lower surface with an intermediate section provided therebetween, a front side, and a rear bearing side;

(ii) a rigid load bearing plate carried on said upper surface;

(iii) a load supporting member carried by said housing including a protruding end portion that projects beyond said rear bearing side of said housing, said protruding end portion of said load supporting member adapted to be inserted into one of said openings in said facing plate of said receptacle, for supporting said offset support member thereon; and (iv) a tensioning member extending through said intermediate section of said housing with an end portion projecting beyond said rear bearing side of said housing for engaging said securing member for tightly drawing said rear bearing side of said housing against said exposed side of said facing plate of said receptacle.

2. The preformed assembly of claim 1, wherein said securing member is a nut with interior threads and wherein said tensioning member is a bolt with exterior threads disposed along said end portion, said exterior threads adapted for mating with said interior threads of said nut.

3. The preformed assembly of claim 1, further comprising recess forming members carried by said back side of said facing plate for forming recesses in the said concrete structure adjacent to said at least first opening and second openings.

4. The preformed assembly of claim 3, wherein said protruding end portion of said load supporting member is adapted to extend into one of said recess forming members, and said end portion of said tensioning member is adapted to extend into one of said recess forming members.

5. The preformed assembly of claim 3, wherein said recess forming members are collapsible.

6. The preformed assembly of claim 5, wherein said protruding end portion of said load supporting member is adapted to extend into one of said recess forming members, and said end portion of said tensioning member is adapted to extend into one of said recess forming members.

7. The preformed assembly of claim 1, wherein said load supporting member is an elongated bar member having a quadrilateral cross-section.

8. The preformed assembly of claim 1, wherein said facing plate is a load bearing plate.

9. The preformed assembly of claim 1, wherein said housing defines a cavity that is filled with cementious material with said tensioning member extending therethrough.

10. The preformed assembly of claim 1, further comprising a vertically extending plate carried by said front side of said housing, said plate defining a hole therethrough adapted for passage of said tensioning member.

11. A preformed assembly for providing an offset support for a vertically extending concrete structure, comprising:

(a) a receptacle for being embedded in a vertically extending concrete structure and an attachable offset support member for projecting out from said receptacle to provide a structural support;

(b) said receptacle including:

(i) a facing plate having an exposed side and an opposing back side;

(ii) a plurality of anchors extending from said back side of said facing plate for anchoring said receptacle in said concrete structure;

(iii) at least a first opening and a second opening provided in said face plate, said at least first opening and second openings being offset from each other;

(iv) recess forming members carried by said back side of said facing plate for forming recesses in the said concrete structure adjacent to said first opening and second openings;

(v) a securing member carried by said backside of said facing plate;

(c) said attachable offset support member including:

(i) a housing having an upper surface and a lower surface with an intermediate section provided therebetween, a front side, and a rear bearing side;

(ii) a rigid load bearing plate carried on top of said upper surface of said housing;

(iii) a load supporting member carried by said housing including a protruding end portion that projects beyond said rear bearing side of said housing, said protruding end portion of said load supporting member adapted to be inserted into one of said openings in said facing plate of said receptacle and extending into one of said recesses, for supporting said offset support member thereon; and (iv) a tensioning member with opposed ends, said tensioning member extending through said intermediate section of said housing with an end portion projecting beyond said housing for engaging said securing member for tightly drawing said rear bearing side of said housing against said facing plate of said receptacle, and an outer end of said tensioning member projecting into another of said recesses.

12. The preformed assembly of claim 11, wherein said securing member is a nut with interior threads and wherein said tensioning member is a bolt with exterior threads disposed along said end portion, said exterior threads adapted for mating with said interior threads of said nut.

13. The preformed assembly of claim 11, wherein said recess forming members are collapsible.

14. The preformed assembly of claim 11, wherein said load supporting member is an elongated bar member having a quadrilateral cross-section.

15. The preformed assembly of claim 11, wherein said facing plate is a load bearing plate.

16. The preformed assembly of claim 11, wherein said housing defines a cavity that is filled with cementious material with said tensioning member extending therethrough.

17. The preformed assembly of claim 11, further comprising a vertically extending plate carried by said front side of said housing, said plate defining a hole therethrough adapted for passage of said tensioning member therethrough.

18. A preformed assembly for providing an offset support for a vertically extending concrete structure, comprising:

(a) a receptacle for being embedded in a vertically extending concrete structure and an attachable offset support member for projecting out from said receptacle to provide a structural support;

(b) said receptacle including:

(i) a load bearing plate having an exposed side and an opposing back side;

(ii) a plurality of anchors extending from said back side of said load bearing plate for anchoring said receptacle in said concrete structure;

(iii) a first opening and a second opening provided in said load bearing plate, said first opening and second openings being offset vertically from each other;

(iv) collapsible recess forming members carried by said back side of said load bearing plate for forming recesses in the said concrete structure adjacent to said first opening and second openings;

(v) a nut with interior threads carried by said backside of said load bearing plate;

(c) said attachable offset support member including:

(i) a housing having an upper generally horizontal surface and a lower generally horizontal surface with opposed generally vertical surfaces provided therebetween, a front side, and a rear bearing side, said housing defining a cavity therein;

(ii) a rigid load bearing plate carried on top of said upper surface of said housing;

(iii) a vertically extending plate carried by said front side of said housing, said plate defining a hole therethrough;

(iv) a load supporting member carried by said housing, said load supporting member being an elongated bar member having a quadrilateral cross-section including a protruding end portion that projects beyond said rear bearing side of said housing, said load supporting member adapted to be inserted into one of said openings in said load bearing plate of said receptacle and extending into one of said recesses, for supporting said offset support member thereon; and (v) a threaded bolt, said bolt extending through said hole defined through said vertically extending plate and said bolt further extending through said cavity of said housing, said bolt with an end portion projecting beyond said housing for engaging said nut for tightly drawing said rear bearing side of said housing against said load bearing plate of said receptacle, and an outer end of said bolt projecting into another recesses.

19. The performed assembly of claim 18, wherein said housing defines a cavity that is filed with cementious material with said bolt extending therethrough.

20. The performed assembly of claim 18, wherein said housing is encased with cementious material.

21. The performed assembly of claim 18, wherein said housing is encased with cementious material.

* * * * *

UNITED STATES PATENT AND TRADEMARK OFFICE

CERTIFICATE OF CORRECTION

PATENT NO. : 6,679,017 B2
DATED : January 20, 2004
INVENTOR(S) : Woodruff, III et al.

It is certified that error appears in the above-identified patent and that said Letters Patent is hereby corrected as shown below:

Column 8,
Lines 50-51, “another recesses” should read -- another of said recesses --

Signed and Sealed this

Twenty-eighth Day of September, 2004

JON W. DUDAS
*Director of the United States Patent and Trademark Office*